United States Patent [19]

Majewicz

[11] 3,967,893

[45] July 6, 1976

[54] ILLUMINATING APPARATUS

[75] Inventor: Edward J. Majewicz, Ontario, N.Y.

[73] Assignee: Xerox Corporation, Stamford, Conn.

[22] Filed: Apr. 29, 1974

[21] Appl. No.: 465,443

[52] U.S. Cl. ..... 355/4; 355/8; 355/20; 355/69

[51] Int. Cl.[2] ..... G03G 15/30

[58] Field of Search ..... 355/69, 70, 67, 37, 355/35, 4, 8, 32, 11, 15, 20; 240/1 R, 3.1, 2.25, 10 R; 40/106.52, 130 L; 340/334; 357/17–19; 358/59; 178/DIG. 28, 7.4; 352/105

[56] References Cited

UNITED STATES PATENTS

| | | | |
|---|---|---|---|
| 2,951,443 | 9/1960 | Byrne | 355/15 X |
| 3,062,108 | 11/1962 | Mayo | 355/8 |
| 3,096,458 | 7/1963 | Demmy | 240/2.25 X |
| 3,115,807 | 12/1963 | Craig et al. | 355/20 |
| 3,359,633 | 12/1967 | Motson | 240/2.25 X |
| 3,595,991 | 7/1971 | Diller | 358/59 |
| 3,612,677 | 10/1971 | Langdon et al. | 355/4 |
| 3,661,452 | 5/1972 | Hewes et al. | 355/3 R |
| 3,700,329 | 10/1972 | Mason | 355/20 X |
| 3,760,174 | 9/1973 | Boenning et al. | 355/70 X |
| 3,779,640 | 12/1973 | Kidd | 355/4 X |

OTHER PUBLICATIONS

IBM Technical Disclosure Bulletin, "Scanner Using Linear Array of Light-Emitting Diodes", Baxter; vol. 15, No. 1, June 1972, p. 4.

*Primary Examiner*—L. T. Hix
*Assistant Examiner*—Kenneth C. Hutchison
*Attorney, Agent, or Firm*—H. Fleischer; J. J. Ralabate; C. A. Green

[57] ABSTRACT

An apparatus in which a charged photoconductive member is exposed to a light image of an original document. An array of solid state light emitters are employed to illuminate the original document. The light image of the original document is projected onto the charged photoconductive member to record thereon an electrostatic latent image.

12 Claims, 3 Drawing Figures

ILLUMINATING APPARATUS

BACKGROUND OF THE INVENTION

This invention relates generally to an electrophotographic printing machine, and more particularly concerns an apparatus adapted to illuminate an original document being reproduced therein.

In the process of electrophotographic printing, a photoconductive surface is uniformly charged and exposed to a light image of an original document. Exposure of the photoconductive surface records thereon an electrostatic latent image corresponding to the original document. The electrostatic latent image is then rendered visible by depositing toner particles which adhere electrostatically thereto in image configuration. Subsequently, the toner powder image is transferred to a sheet of support material which may be plain paper or a transparent thermoplastic material, amongst others. The toner powder image is, then, permanently affixed to the support material so as to produce a copy of the original document.

The process of multi-color electrophotographic printing is similar to the process of black and white printing. However, rather than forming a total light image of the original document, the light image is filtered producing a single color light image which is a partial light image of the original document. This single color light image exposes the charged photoconductive surface recording thereon a single color electrostatic latent image. The single color electrostatic latent image is then developed with toner particles of a color complementary to the single color light image. Each single color toner powder image is transferred to the support material in superimposed registration with the prior toner powder image forming thereon a composite multi-layered toner powder image. This multi-color toner powder image is permanently affixed to the support material.

A typical light source may be a tri-phosphor lamp. This type of lamp is arranged to have peak energy outputs at the blue, green and red wave lengths. The corresponding filters are arranged to permit a single color light image to pass therethrough. Hence, a blue filter would only permit the blue light image to be transmitted therethrough, a red filter only a red light image, and a green filter only a green light image. Moreover, it is frequently necessary to advance the lamp along the original document so as to create a flowing light image thereof which is in synchronism with the rotation of the photoconductive drum. In addition, the energy furnished to excite the lamps has to be sufficient to provide minimum brightness for all the various single color images being produced on the photoconductive surface.

The foregoing may be more readily achieved by the employment of solid state light emitters. The usage of light emitting surfaces is disclosed in U.S. Pat. No. 3,438,057 issued in 1969 to Neitzel. This patent discloses a seismic recording system having an elongated solid state light emitting array for exposing a photoconductive film to produce seismic traces thereon.

Heretofore, light emitting diodes have been employed as alpha-numeric display devices. A display device of this type may be electrically coupled to a computer and an electrophotographic printing machine to produce a non-impact printer. This type of system is disclosed by Harris on Page 3,758, Volume 13, No. 12 of the May 1971 IBM Technical Disclosure Bulletin. As shown therein, light emitting diodes are selectively excited by a computer to produce image patterns of print characters. These image patterns illuminate a charged photoconductive drum so as to discharge the photoconductive drum locally in the image pattern of the light emitting diodes. This creates an electrostatic latent image on which a powder image is developed and subsequently transferred to a copy sheet. Thereafter, the powder image is permanently fused to the copy sheet. Other systems of the above-identified type employ cathode ray tubes associated with computers to create illuminated image patterns which discharge the charged photoconductive surface.

However, none of the prior art devices teach the employment of solid state light emitters for creating single color light images or for eliminating the scanning requirement when reproducing transparencies.

Accordingly, it is the primary object of the present invention to improve the exposure system used in an electrophotographic printing machine by the employment of an array of solid state light emitters therein.

SUMMARY OF THE INVENTION

Briefly stated, and in accordance with the present invention, there is provided an apparatus for exposing a charged photoconductive member to record thereon an electrostatic latent image corresponding to an original document.

Pursuant to the present invention, an array of solid state light emitters illuminate the original document. Means are provided for supporting the original document in a light receiving relationship with the light emitters. Projecting means are positioned to direct the light rays transmitted from the original document onto the charged photoconductive member. The light rays irradiate and selectively discharge the charged photoconductive member recording thereon an electrostatic latent image corresponding to the original document.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
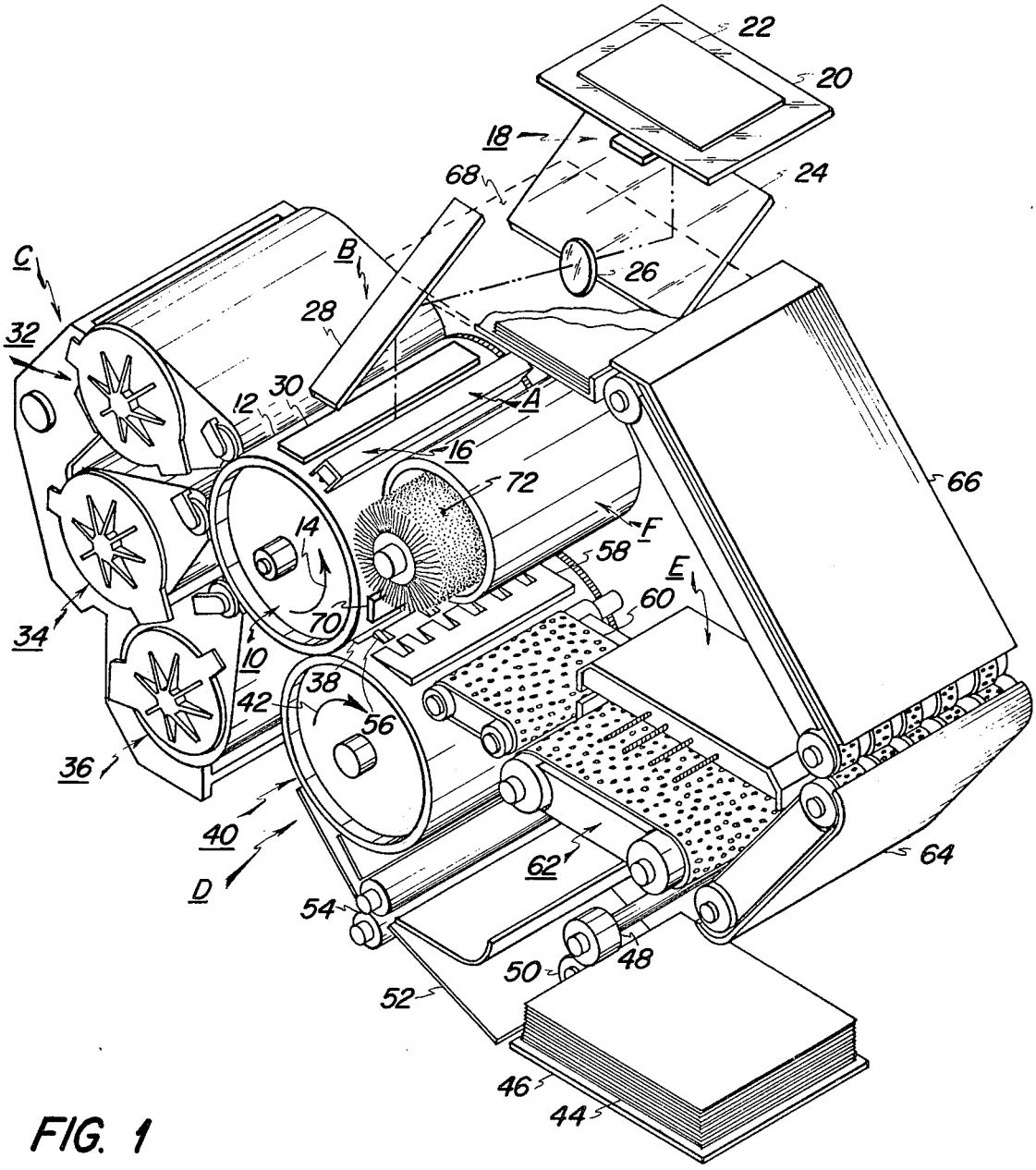
FIG. 1 is a schematic perspective view of a color electrophotographic printing machine incorporating the features of the present invention therein.

With continued reference to the drawings wherein like reference numerals have been used throughout to indicate like elements, FIG. 1 schematically illustrates the components of an electrophotographic printing machine adapted to create color copies from a colored original document.

As depicted schematically in FIG. 1, the multicolor electrophotographic printing machine adapted to employ the present invention therein, comprises a rotatably mounted drum 10 having a photoconductive surface 12 entrained about and secured thereto. A drive motor (not shown) rotates drum 10 in the direction of arrow 14 causing photoconductive surface 12 to pass sequentially through a plurality of processing stations. A timing disc (not shown) is mounted in the region of one end of the shaft of drum 10. The timing disc includes a plurality of slits in the region of the periphery thereof being opaque in the other regions. A photocell is mounted on one side of the timing disc with a light source on the other side thereof. As the timing disc rotates, it acts as a light chopper. The photocell receives pulses of light through the slits in the timing disc and, in turn, generates an electrical signal indicative thereof. Logic circuitry associated with the photocell controls the events at the respective processing stations so as to be in synchronism with the rotation of drum 10.

Initially, drum 10 rotates in the direction of arrow 14 to advance photoconductive surface 12 through charging station A. Charging station A has positioned thereat a corona generating device, indicated generally at 16. As illustrated in FIG. 1, corona generating device 16 is arranged to extend in a generally transverse direction across photoconductive surface 12. Corona generating device 16 charges photoconductive surface 12 to a relatively high substantially uniform potential. U.S. Pat. No. 2,778,946 issued to Mayo in 1957 describes a suitable corona generating device which may be employed in the type of electrophotographic printing machine being described.

After photoconductive surface 12 is charged to a substantially uniform potential, drum 10 rotates to exposure station B. At exposure station B, photoconductive surface 12 is exposed to a single color light image of the original document. An array of solid state light emitters, indicated generally by the reference numeral 18, is disposed beneath platen 20 and arranged to project light rays of a single color onto original document 22 disposed on platen 20. Solid state light emitter 18 is adapted to move across original document 22 so as to illuminate incremental areas thereof. The detailed structural configuration of solid state light emitter 18 will be described hereinafter in greater detail with reference to FIG. 2. One type of drive system for moving solid state light emitter 18 is described in U.S. Pat. No. 3,062,108 issued to Mayo in 1962. Original document 22 is supported stationarily upon transparent viewing platen 20. Solid state light emitter 18 moves in a timed relation with drum 10 scanning successive incremental areas of original document 22 positioned upon platen 20. The light rays reflected from original document 22 are directed by mirror 24 to pass through lens 26 which forms a flowing light image thereof. This flowing light image is then reflected from mirror 28 onto photoconductive surface 12 to irradiate selected areas thereof. As the flowing light image irradiates selected areas of the charged photoconductive surface, it dissipates the charge recording a single color electrostatic latent image thereon. Lens 26 moves with solid state light emitter 18. The single color electrostatic latent image recorded on photoconductive surface 12 corresponds to a preselected spectral region of the electromagnetic wave spectrum. After solid state light emitter 18 has completed its scan of original document 22 it returns to the initial start position. As drum 10 continues to rotate, the electrostatic latent image recorded on photoconductive surface 12 passes beneath a second solid state light emitter 30. After the trailing edge of the electrostatic latent image has passed beneath solid state light emitter 30, light emitter 30 is energized. The timing disc hereinbefore described in conjunction with the machine logic actuates light emitter 30 at the appropriate time. In this manner, any charge remaining on photconductive surface 12 is discharged therefrom. The light rays from light emitter 30 have a suitable spectral characteristic to discharge photoconductive surface 12. After the single color electrostatic latent image passes beneath light emitter 30, it enters development station C.

Development station C includes three individual developer units, generally indicated by the reference numerals 32, 34 and 36, respectively. A suitable development system employing a plurality of developer units is disclosed in co-pending application Ser. No. 255,259 filed in 1972, now U.S. Pat. No. 3,854,449. As disclosed in the foregoing patent application, the developer units are all of a magnetic brush type. Generally, a magnetic brush developer unit employs a magnetizable developer mix having carrier granules and toner particles. This developer mix is brought continually through a directional flux field to form a brush thereof. Development is achieved by bringing the single color electrostatic latent image recorded on photoconductive surface 12 into contact with the brush of developer mix. Toner particles corresponding in color to the complement of the single color light rays generated by light emitter 18 are contained within each of the respective developer units. For example, a green electrostatic latent image is rendered visible by depositing green absorbing magenta toner particles. Similarly, blue and red latent images are developed with yellow and cyan toner particles, respectively.

After the formation of a toner powder image on photoconductive surface 12, drum 10 rotates to transfer station D. At transfer station D, the powder image adhering electrostatically to photoconductive surface 12 is transferred to a sheet of support material 38. Support material 38 may be plain paper or, in the formation of trnsparencies, a thermoplastic transparent material. A bias transfer roll shown generally at 40, recirculates support material 38 in the direction of arrow 42. Transfer roll 40 is electrically biased to a potential of sufficient magnitude and polarity to electrostatically attract toner particles from photoconductive surface 12 to support material 38. U.S. Pat. No. 3,612,677 issued to Langdon in 1972 describes a suitable electrically biased transfer roll. Transfer roll 40 is arranged to rotate in synchronism with photoconductive surface 12, i.e., transfer roll 40 and drum 10 rotate substantially at the same angular velocity and have substantially the same outer diameter. Inasmuch as support material 38 is secured releasably to transfer roll 40 for movement therewith in a recirculating path, successive toner powder images may be transferred thereto. Thus, each of the toner powder images are transferred to support material 38 in superimposed registration with one another. In this manner, a multilayered toner powder image is formed on support material 38.

With continued reference to FIG. 1, the path for advancing support material 38 to transfer roll 40 will be briefly described. A stack 44 of support material 38 is supported on tray 46. Feed roll 48, operatively associated with retard roll 50, separates and advances the uppermost sheet from stack 44. The advancing sheet moves into chute 52 and is directed into the nip of register roll 54. Next, gripper fingers 56, mounted on transfer roll 40, releasably secure thereto support material 38 for movement therewith in a recirculating path. After all of the single color toner powder images have been transferred to support material 38, gripper fingers 56 space support material 38 from transfer roll 40 permitting stripper bar 58 to be interposed therebetween. Support material 38 thereupon passes over stripper bar 58 and onto endless conveyor belt 60.

Endless belt conveyor 60 advances support material 38 to fixing station E, where a fuser indicated generally at 62, permanently affixes the transferred toner powder image to support material 38. A suitable fuser is described in U.S. Pat. No. 3,498,592 issued to Moser et al. in 1970. After the toner powder images are permanently affixed to support material 38, support material 38 is advanced by endless belt conveyors 64 and 66 to catch tray 68. At catch tray 68, an operator may remove the color copy from the elecrophotographic printing machine.

After the toner powder images have been transferred to support material 38, drum 10 continues to rotate in the direction of arrow 14. A third solid state light emitter 70 is disposed after transfer station D. Solid state light emitter 70 produces light rays having the appropriate spectral characteristics to discharge photoconductive surface 12 to a substantially uniform level permitting it to be recharged thereafter by corona generating device 16 to a higher repeatable potential for each successive cycle. In addition, it substantially removes any electrostatic charge attracting residual toner particles thereto. After light emitter 70 has discharged the remaining charge on photoconductive surface 12, photoconductive surface 12 rotates to cleaning station F. At cleaning station F, a brush cleaning device of the type described in U.S. Pat. No. 3,590,412 issued to Gerbasi in 1971, removes any residual toner particles adhering thereto. This is achieved by a brush 72 mounted rotatably in contact with photoconductive surface 12.

Figure 2:
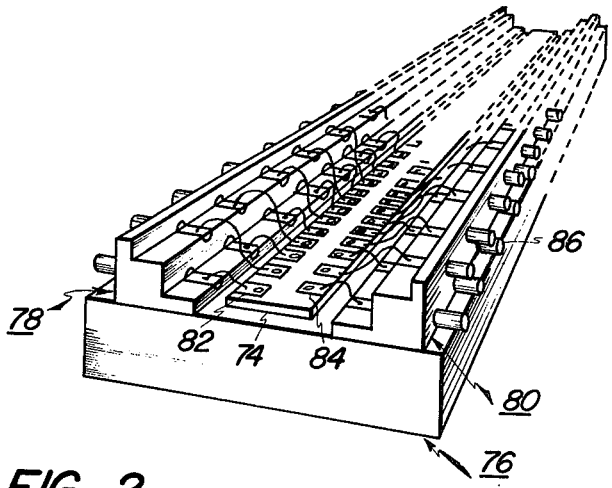
FIG. 2 shows an array of solid state light emitters adapted to be employed in the FIG. 1 printing machine.

Turning now to FIG. 2, solid state light emitter 18 will be described in detail. It should be noted that solid state light emitters 30 and 70 are substantially identical to solid state light emitter 18. The only distinction between the respective solid state light emitters is that solid state light emitter 18 includes light emitting surfaces adapted to generate differently colored light rays therefrom. For example, solid state light emitter 18 has one row of red light emitting surfaces, a second row of green light emitting surfaces, and a third row of yellow light emitting surfaces. Contrawise, solid state light emitters 30 and 70 only have light emitting surfaces arranged to produce substantially white light therefrom. One type of solid state light emitter includes a gallium arsenide substrate 74 mounted on a base 76 along with a pair of terminal blocks 78 and 80. Substrate 74 is made of n-type material and has a plurality of p-type light emitting surfaces, such as surfaces 82 anad 84 thereon. This provides an array of light emitting elements which may be actuated by application of suitable control potentials to the input terminals 86 on block 80. In this type of embodiment, the light emitters are dots 0.005 inches on centers of 0.010 inches to form row 88 which includes surfaces 82. Row 90 is similarly formed. Thus, a substantially continuous illumination path is provided. The array of FIG. 2 may include, for example, 100 such emitters on a block or substrate 74 approximately ½ inch in length. A plurality of such substrates may be employed to obtain the desired length and width. For example, 20 such substrates would be required in order to illuminate a photoconductive drum ten inches wide.

The general operation and construction of the light emitters is well known. Suitable units are described in Electronic Design, Sept. 27, 1966, at Page 67 et seq. Miniaturization and integrated circuit technology have provided such emitters primarily in two-dimensional arrays. Such light sources may be individually modulated with a turn-on time as low as 50 nanoseconds. Heretofore, such arrays have been employed for alphanumerical displays with high speed printout capabilities.

In accordance with the present invention, a plurality of substrates mounted on a block such as 76 would extend parallel to photoconductive surface 12 of drum 10 to provide the capability for illuminating the entire width of drum 10. It should be noted that the rows of light emitting surfaces are adapted to produce single color light rays therefrom. Thus, the first row of light emitting surfaces would produce red light rays, the second row green light rays, and the third row yellow light rays with the following successive sets of rows also so arranged. This obviates the requirement for a filter in the electrophotographic printing machine. The actuation of the appropriate row of light emitting surfaces is controlled by the logic in the electrophotographic printing machine. Hence, for the first cycle the row of red light emitting surfaces is energized so as to create a red light image which is developed with cyan toner particles. Subsequently, the row of green light emitting surfaces is energized to produce a green light image which is developed with magenta toner particles. Finally, the row of yellow light emitting surfaces is actuated to produce a yellow light image which is developed with cyan toner particles.

Figure 3:
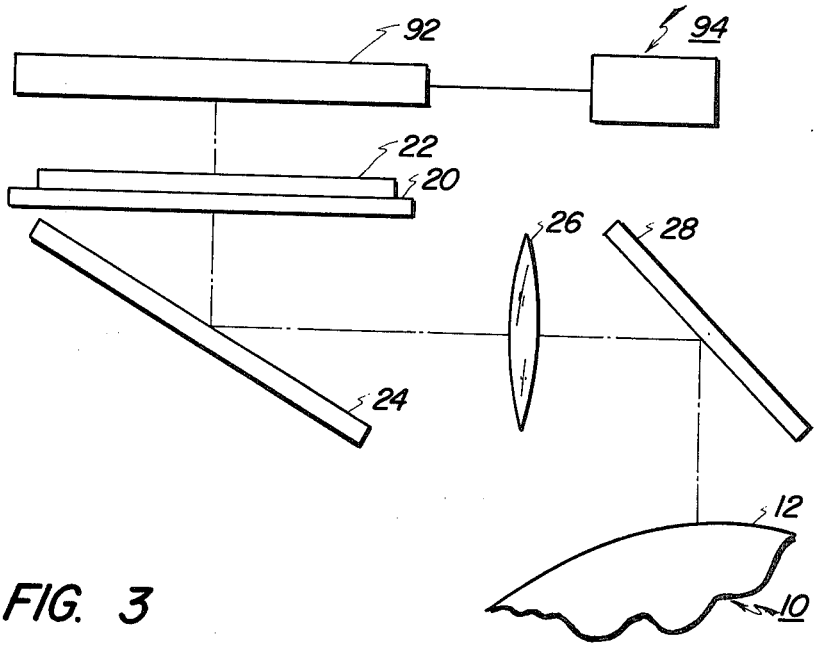
FIG. 3 illustrates an alternate embodiment of the FIG. 1 printing machine exposure system.

Turning now to FIG. 3, there is shown an alternate embodiment of the present invention. As employed therein a solid state light emitter 92 is disposed above platen 20 and extends over the entire length and width thereof. This embodiment is only applicable when original document 22 is a transparency. In this case, successive rows of light emitting surfaces are actuated to scan transparency 22 and to transmit light rays therethrough forming a flowing light image. This eliminates the requirement for a drive system to move the light emitter. Successive rows of light emitting surfaces on light emitter 92 are actuated in synchronism with the rotation of drum 10 to project the light image thereon. Once again, these rows could be adapted to produce single color light rays therefrom or, in the alternative, substantially white light rays therefrom. Energization of the respective rows of light emitting surfaces on solid state light emitter 92 is regulated by controller 94. The timing disc mounted on the shaft of drum 10, in conjunction with the machine logic generates clock pulses. Controller 94 is responsive to the clock pulses and regulates the energization of solid state light emitter 92 to selectively energize rows thereof. The energization of selected rows of solid state light emitter 92 is in synchronism with the rotation of drum 10. The single color light rays transmitted from solid state light emitter 92 are transmitted through transparency 22 and platen 20 onto mirror 24. Mirror 24 reflects the single color light rays through lens 26 which forms a single color light image. The single color light image is reflected from mirror 28 onto charged photoconductive surface 12 so as to record color electrostatic latent image thereon. In this manner, successive single color electrostatic latent images may be created on photoconductive surface 12 corresponding to portions of transparency 22. Moreover, this technique would eliminate the requirement for a drive system to move the lamps or solid state light emitter across platen 20. Once again, it should be noted that this approach would only be applicable for transparencies where the light rays may be transmitted therethrough rather than reflected therefrom.

In addition to energizing selected rows of light emitting surfaces on the solid state light emitters, the brightness of each one of the rows may be controlled. As previously indicated, the power to each row of light emitting surfaces (or of each color), may be suitably tailored therefor. This could be achieved by energizing each row of light emitting surfaces at a different level corresponding to the optimum brightness required therefor.

In recapitulation, the apparatus of the present invention produces single color light rays which are adapted to illuminate an original document with optimum brightness. Moreover, in the case of transparencies, actuation of selected rows in synchronism with the movement of the photoconductive surface eliminates the lamp drive system for transparencies. This apparatus substantially reduces cost and improves reliability.

It is, therefore, evident that there has been provided in accordance with the present invention an illuminating apparatus that fully satisfies the objects, aims and advantages set forth above. While this invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for exposing a moving charged photoconductive member to record thereon an electrostatic latent image corresponding to an original document, including:

an array of solid state light emitters, said array comprising a plurality of parallel rows of solid state light emitters;

means for supporting the original document in a light receiving relationship with said array of solid state light emitters, said array of solid state light emitters illuminating the original document;

means for projecting the light rays transmitted from the original document onto the charged photoconductive member;

means for driving the photoconductive member at a substantially constant velocity;

means for successively energizing parallel rows of said array of solid state light emitters;

timing means, operatively associated with the photoconductive member, for generating an electrical signal indicative of the movement of the photoconductive member; and circuit means coupling said timing means with said energizing means to excite successive rows of said light emitters in a timed relation with the movement of the photoconductive member to transmit light rays corresponding to successive portions of the original document to said projecting means.

2. An apparatus as recited in claim 1, wherein:

said timing means includes generator means synchronized with the movement of the photoconductive member for producing clock pulses; and said circuit means includes logic means, responsive to the clock pulses from said generator means, for regulating said energizing means to selectively energize successive rows of said array of solid state light emitters.

3. An apparatus for exposing a moving charged photoconductive member to record thereon an electrostatic latent image corresponding to an original document, including:

an array of solid state light emitters, said array comprising a plurality of parallel rows of solid state light emitters with each row of solid state light emitters being of a pre-selected single color;

means for supporting the original document in a light receiving relationship with said solid state light emitters, said array of solid state light emitters illuminating the original document;

means for projecting the light rays transmitted from the original document onto the charged photoconductive member;

means for driving the photoconductive member at substantially constant velocity;

means for successively energizing selected parallel rows of said array of solid state light emitters to produce light rays of a pre-selected single color;

timing means operatively associated with the photoconductive member, for generating an electrical signal indicative of the movement of the photoconductive member; and circuit means coupling said timing means with said energizing means to excite successive rows of said light emitters in a timed relation with the movement of the photoconductive member to transmit light rays of the pre-selected single color corresponding to successive portions of the original document having the pre-selected single color to said projecting means.

4. An apparatus as recited in claim 3, further including means for controlling said energizing means to regulate the brightness of the single color light rays.

5. An electrophotographic printing machine adapted to create a copy from an original document, including:

a photoconductive member;

means for charging said photoconductive member to a substantially uniform potential;

a first array of solid state light emitters mounted in the printing machine, said first array comprising a plurality of parallel rows of solid state light emitters;

means for supporting the original document in a light receiving relationship with said first array of solid state light emitters, said first array of solid state light emitters illuminating the original document;

means for projecting the light rays transmitted from the original document onto said charged photoconductive member recording thereon an electrostatic latent image corresponding to the original document;

means for driving the photoconductive member at substantially constant velocity;

means for successively energizing parallel rows of said first array of solid state light emitters;

timing means, operatively associated with said photoconductive member, for generating an electrical signal indicative of the movement of said photoconductive member; and circuit means coupling said timing means with said energizing means to excite successive rows of said light emitters in a timed relation with the movement of said photoconductive member to transmit light rays corresponding to successive portions of the original document to said projecting means.

6. A printing machine as recited in claim 5, wherein:

said timing means includes generator means synchronized with the movement of the photoconductive member for producing clock pulses; and said circuit means includes logic means, responsive to the clock pulses from said generator means, for regulating said energizing means to selectively energize successive rows of said first array of solid state light emitters.

7. A printing machine as recited in claim 5, further including:

means for depositing toner particles onto the electrostatic latent image recorded on said photoconductive member forming a toner powder image thereon;

means for transferring the toner powder image from said photoconductive member to a copy sheet; and means for affixing substantially permanently the toner powder image to the copy sheet.

8. A printing machine as recited in claim 7, further including:

a second array of solid state light emitters mounted in the printing machine in a position to direct light rays onto said photoconductive member at a point in the path of movement of said photoconductive member after said transfer means; and means for energizing said second array of solid state light emitters after the toner powder has been transferred from said photoconductive member to the copy sheet so as to remove charges remaining on said photoconductive member and on residual toner adhering thereto.

9. An electrophotographic printing machine adapted to create a copy from an original document, including:

a photoconductive member;

means for charging said photoconductive member to a substantially uniform potential;

a first array of solid state light emitters mounted in the printing machine, said first array comprising a plurality of parallel rows of solid state light emitters with each row of solid state light emitters being of a pre-selected single color;

means for supporting the original document in a light receiving relationship with said first array of solid state light emitters, said first array of solid state light emitters illuminating the original document;

means for projecting the light rays transmitted from the original document onto said charged photoconductive member recording thereon an electrostatic latent image corresponding to the original document;

means for successively energizing selected parallel rows of said first array of solid state light emitters to produce light rays of a pre-selected single color so as to record successive single color electrostatic latent images on said charged photoconductive member;

timing means, operatively associated with said photoconductive member, for generating an electrical signal indicative of the movement of said photoconductive member; and circuit means coupling said timing means with said energizing means to excite successive rows of said light emitters in a timed relation with the movement of said photoconductive member to transmit light rays of the pre-selected single color corresponding to successive portions of the original document having the pre-selected single color to said projecting means.

10. A printing machine as recited in claim 9, further including:

means for depositing toner particles of a complementary color onto the electrostatic latent image recorded on said photoconductive member forming successive single color toner powder images thereon;

means for transferring successive single color toner powder images from said photoconductive member to the copy sheet in superimposed registration with one another forming a multi-colored toner powder image on the copy sheet; and means for affixing substantially permanently the multi-colored toner powder image to the copy sheet.

11. A printing machine as recited in claim 10, further including means for controlling said energizing means to regulate the brightness of the single color light rays emitted from said first array of solid state light emitters.

12. A printing machine as recited in claim 10, further including:

a third array of solid state light emitters mounted in the printing machine after said first array of solid state light emitters; and means for energizing said third array of solid state light emitters after the trailing edge of the electrostatic latent image has passed to discharge said photoconductive member in the non-image regions.

* * * * *